US012135034B2

(12) United States Patent
Yeh et al.

(10) Patent No.: US 12,135,034 B2
(45) **Date of Patent: *Nov. 5, 2024**

(54) THIN PUMP

(71) Applicant: COOLER MASTER CO., LTD., Taipei (TW)

(72) Inventors: Chiu Yu Yeh, Taipei (TW); Wen-Hsien Lin, Taipei (TW); Wen-Hung Chen, Taipei (TW); Chia-Hao Sung, Taipei (TW)

(73) Assignee: COOLER MASTER CO., LTD., Taipei (TW)

( * ) Notice: Subject to any disclaimer, the term of this patent is extended or adjusted under 35 U.S.C. 154(b) by 167 days.

This patent is subject to a terminal disclaimer.

(21) Appl. No.: 17/961,360

(22) Filed: Oct. 6, 2022

(65) Prior Publication Data

US 2023/0035497 A1 Feb. 2, 2023

Related U.S. Application Data

(63) Continuation-in-part of application No. 17/017,389, filed on Sep. 10, 2020, now Pat. No. 11,493,047.

(30) Foreign Application Priority Data

Apr. 1, 2020 (TW) ..... 109111160

(51) Int. Cl.

| | |
|---|---|
| ***F04D 25/06*** | (2006.01) |
| ***F04D 1/00*** | (2006.01) |
| ***F04D 17/16*** | (2006.01) |
| ***F04D 29/42*** | (2006.01) |

(52) U.S. Cl.
CPC ..... *F04D 25/06* (2013.01); *F04D 1/00* (2013.01); *F04D 17/16* (2013.01); *F04D 29/4226* (2013.01); *F04D 29/426* (2013.01)

(58) Field of Classification Search
CPC ..... F04D 1/04; F04D 13/06; F04D 13/064; F04D 25/0653; F04D 29/426; F04D 29/669; G06F 1/203; G06F 2200/201
See application file for complete search history.

(56) References Cited

U.S. PATENT DOCUMENTS

| | | | | |
|---|---|---|---|---|
| 2005/0249609 | A1* | 11/2005 | Ito | F04D 13/0673 417/353 |
| 2005/0265833 | A1* | 12/2005 | Tomioka | F04D 13/064 415/206 |
| 2014/0205480 | A1* | 7/2014 | Nakano | F04D 29/4293 417/420 |
| 2021/0301826 | A1* | 9/2021 | Horng | F04D 29/4293 |

* cited by examiner

*Primary Examiner* — Kenneth J Hansen
(74) *Attorney, Agent, or Firm* — Maschoff Brennan

(57) ABSTRACT

This disclosure relates to a thin pump including a case, a rotor, and a stator. The case has a bottom surface, a lower chamber, an upper chamber, and an accommodation space. The upper chamber is located further away from the bottom surface than the lower chamber. The upper chamber has two opposite ends respectively in fluid communication with the lower chamber and the accommodation space. The rotor includes an impeller and a magnet. The impeller is rotatably disposed in the lower chamber of the case. The magnet is disposed on the impeller. The stator is disposed in the case. The stator corresponds to the magnet of the rotor so as to drive the rotor to rotate with respect to the case.

6 Claims, 13 Drawing Sheets

THIN PUMP

CROSS-REFERENCE TO RELATED APPLICATIONS

This application is a continuation-in-part application of earlier non-provisional application Ser. No. 17/017,389 filed on Sep. 10, 2020, which claims priority under 35 U.S.C. § 119(a) on Patent Application No(s). 109111160 filed in Taiwan, R.O.C. on Apr. 1, 2020, the entire contents of which are hereby incorporated by reference.

TECHNICAL FIELD

The present disclosure relates to a pump, more particularly to a thin pump.

BACKGROUND

As computer technology progresses, computer system can provide higher performance and, hence, more heat than lower performance devices. In order to prevent an overly high working temperature to damage internal electronic/electronic components, there is provided a passive heat exchanger, such as a heatsink, for absorbing heat generated by the electronic/electronic components. However, the heat dissipation efficiency of the heatsinks are very limited and sometimes not sufficient to catch the heat dissipation requirement of the electronic components nowadays. An alternative option is a liquid-cooling system. The liquid-cooling system is known for having a better heat dissipation performance than heatsink. A typical liquid-cooling system may include a radiator, a liquid plate, and a pump, where the radiator and the liquid plate are in fluid communication with each other, and the working fluid is pumped through the radiator and the liquid plate by the pump to form a circulation. The liquid plate can be mounted on a heat source (e.g., processor), the working fluid flowing through the liquid plate can absorb heat generated from the heat source and can be pumped to the radiator for heat dissipation.

In recent years, in order to satisfy demands for lightweight and small, designs of electronic products are developed toward being light, thin, short, and small. Some manufactures believed that to reduce the size of the pump is a solution to make the electronic products become thinner, however, in fact, the typical small-sized pumps are unable to offer sufficient hydraulic head to maintain the original function. In other words, a pump that has sufficient hydraulic head is, typically, large in size and therefore does not fit the trend. Typically, a pump is worked with an external tank to prevent noise caused by bubbles flowing through the impeller therein. The external tank makes the whole cooling system large in size, but the cooling system without it would affect the performance. Therefore, how to make a balance among small size, performance, and low noise of a pump is an important topic in the field.

SUMMARY

The present disclosure provides a thin pump that is beneficial to reach a balance among small volume, high performance, and low noise.

According to one aspect of the present disclosure, a thin pump including a case, a rotor, and a stator. The case has a bottom surface, a lower chamber, an upper chamber, and an accommodation space. The upper chamber is located further away from the bottom surface than the lower chamber. The upper chamber has two opposite ends respectively in fluid communication with the lower chamber and the accommodation space. The rotor includes an impeller and a magnet. The impeller is rotatably disposed in the lower chamber of the case. The magnet is disposed on the impeller. The stator is disposed in the case. The stator corresponds to the magnet of the rotor so as to drive the rotor to rotate with respect to the case.

According to the thin pump discussed above, the accommodation space existing at the upstream side of the upper chamber and the lower chamber can be served as a tank for the impeller of the thin pump, thus the accommodation space is beneficial to eliminate the bubbles in the working fluid before the working fluid flows into the impeller. As such, there will be no bubbles flowing into the impeller and thus noise that resulted from the bubbles and the impeller is significantly reduced or prevented. In other words, the arrangement of the accommodation space respect to the lower chamber in which the impeller is located makes the thin pump have the functions of both a pump and a tank and therefore achieve a balance among small size, high performance, and low noise. Accordingly, the thin pump is suitable for a computer system (or an electronic apparatus) with limited internal space while maintaining required cooling performance.

BRIEF DESCRIPTION OF THE DRAWINGS

The present disclosure will become more fully understood from the detailed description given hereinbelow and the accompanying drawings which are given by way of illustration only and thus are not intending to limit the present disclosure and wherein.

DETAILED DESCRIPTION

Figure 1:
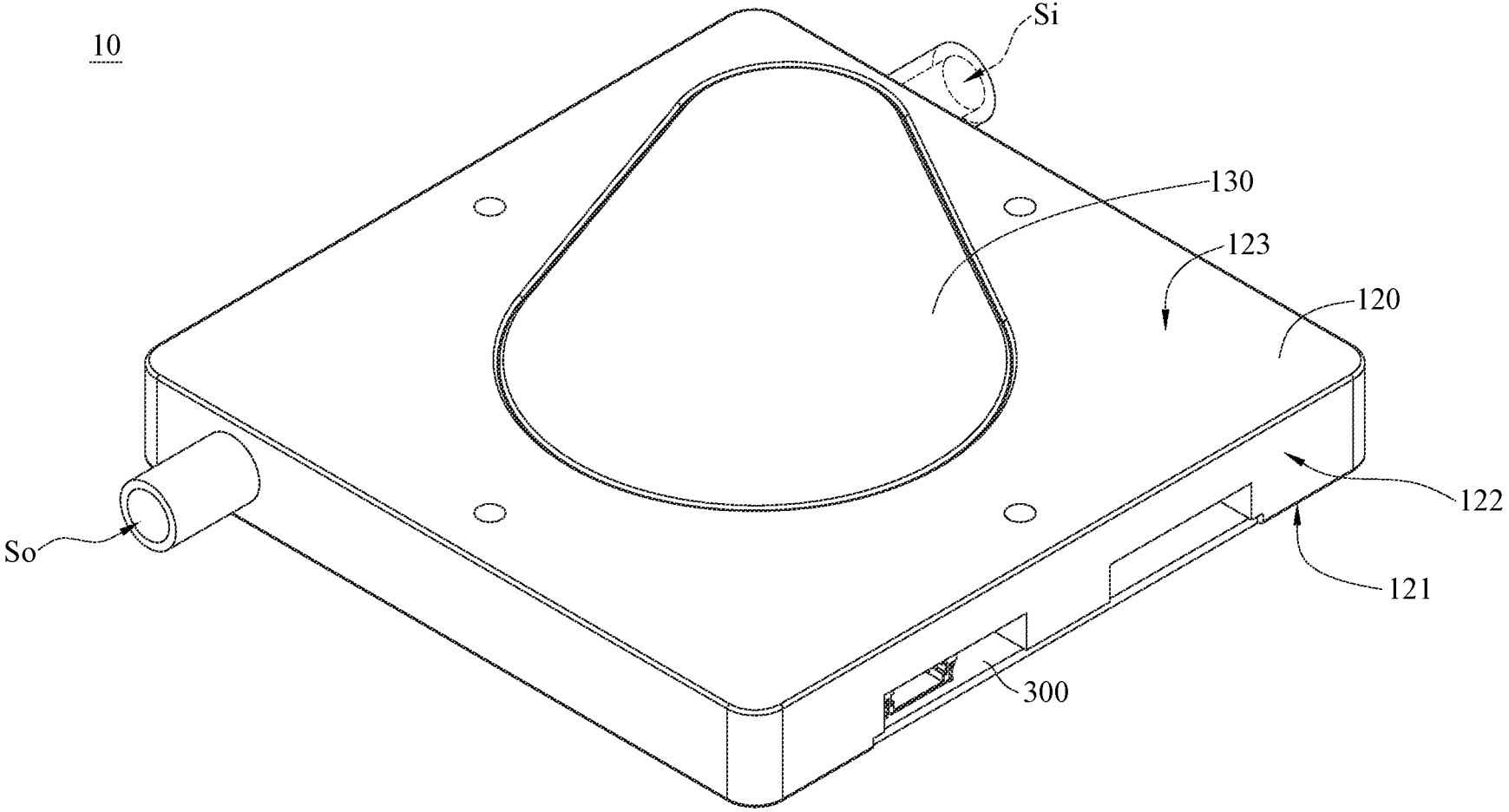
FIG. 1 is a perspective view of a thin pump according to one embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
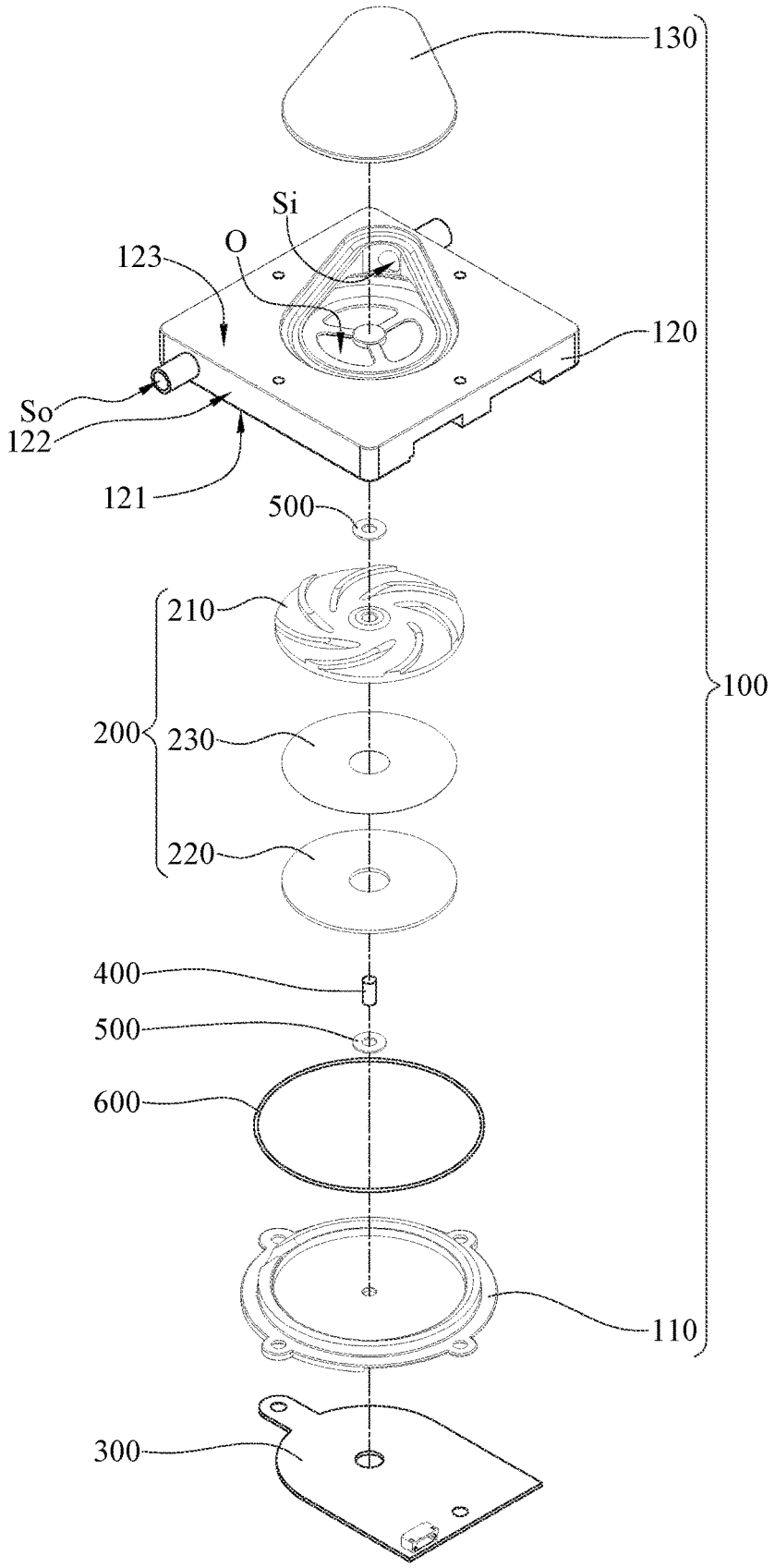
FIG. 2 is an exploded view of the thin pump in FIG. 1.
Figure 3:
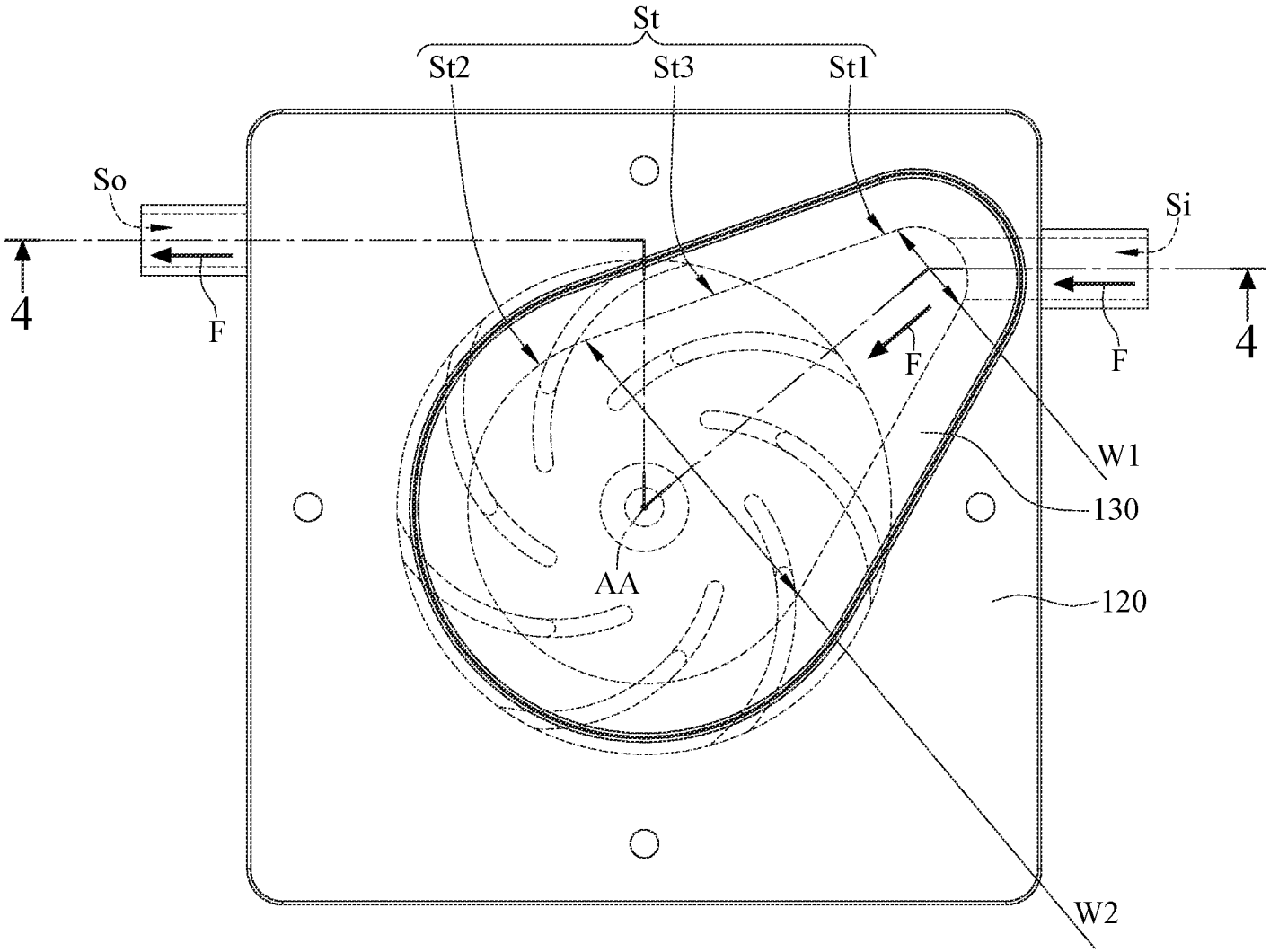
FIG. 3 is a top view of the thin pump in FIG. 1.
Figure 4:
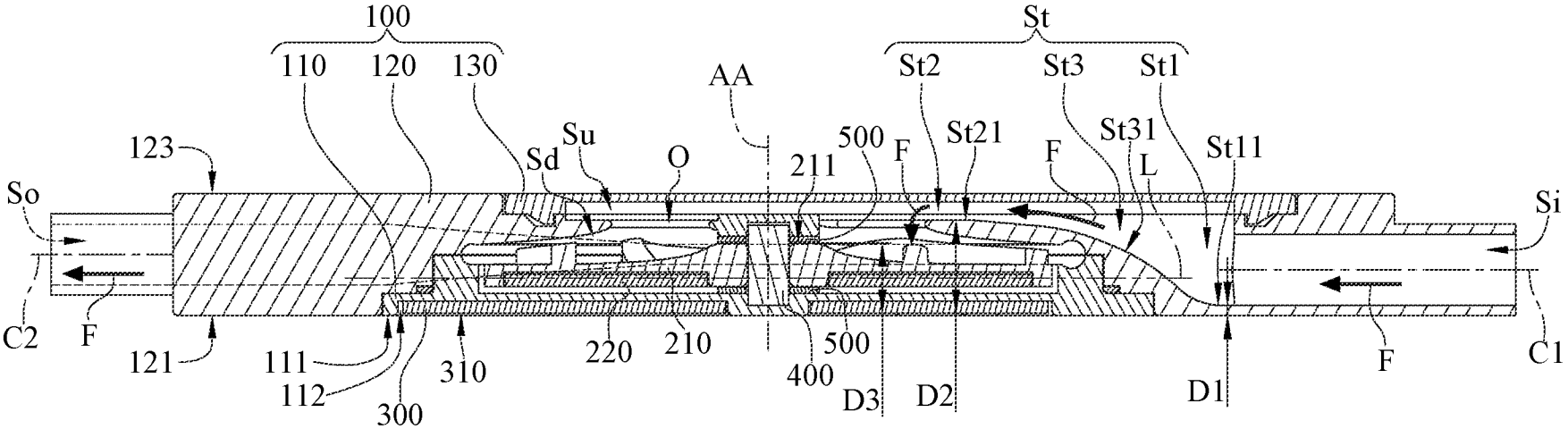
FIG. 4 is a cross-sectional view of the thin pump taken along a line 4-4 in FIG. 3.

Please refer to FIG. 1 to FIG. 4, where FIG. 1 is a perspective view of a thin pump according to one embodiment of the present disclosure, FIG. 2 is an exploded view of the thin pump in FIG. 1, FIG. 3 is a top view of the thin pump in FIG. 1, and FIG. 4 is a cross-sectional view of the thin pump taken along a line 4-4 in FIG. 3.

As shown in FIG. 1 and FIG. 2, this embodiment provides a thin pump 10 including a casing 100, a rotor 200, and a stator 300. In addition, the thin pump 10 further includes a shaft 400, two washers 500, and a seal ring 600.

As shown in FIG. 2 and FIG. 4, the casing 100 includes a bottom part 110, a top part 120, and a cover 130. The top part 120 is disposed on the bottom part 110, and the seal ring 600 is located between and clamped by the bottom part 110 and the top part 120 so as to seal the gap between the bottom part 110 and the top part 120. The top part 120 and the bottom part 110 form a lower chamber Sd therebetween. The bottom part 110 has a bottom surface 111, and the top part 120 has a bottom surface 121, an outer surface 122, and a top surface 123. The bottom surface 121 of the top part 120 and the bottom surface 111 of the bottom part 110 are substantially coplanar. The top surface 123 of the top part 120 faces away from the bottom surface 121 of the top part 120. The outer surface 122 of the top part 120 is located between the top surface 123 of the top part 120 and the bottom surface 121 of the top part 120. Two opposite sides of the outer surface 122 are respectively connected to an edge of the bottom surface 121 of the top part 120 and an edge of the top surface 123 of the top part 120. The outer surface 122 surrounds the lower chamber Sd.

In addition, the top part 120 has an upper chamber Su, a plurality of through holes O, an inlet channel Si, a ramp St, and an outlet channel So. The upper chamber Su is surrounded by the outer surface 122. The upper chamber Su is located further away from the bottom surface 121 of the top part 120 than the lower chamber Sd. The upper chamber Su and the lower chamber Sd are connected via the through holes O. One end of the inlet channel Si is located on the outer surface 122 of the top part 120, and the inlet channel Si is served as an inlet for a working fluid. The ramp St has a first portion St1, a second portion St2, and a middle portion St3. The first portion St1 is connected to the second portion St2 via the middle portion St3. The first portion St1 of the ramp St is connected to the inlet channel Si, and the second portion St2 of the ramp St is connected to the upper chamber Su. That is, the inlet channel Si is connected to the upper chamber Su via the ramp St. The working fluid is allowed to flow into the inlet channel Si and flow to the upper chamber Su via the first portion St1, the middle portion St3, and the second portion St2 of the ramp St.

A first surface St11 of the first portion St1 of the ramp St is located closer to the bottom surface 121 of the top part 120 than a second surface St21 of the second portion St2 of the ramp St. As shown in FIG. 4, a distance D1 between the first surface St11 and the bottom surface 121 is less than a distance D2 between the second surface St21 and the bottom surface 121 in a direction (not shown, parallel to a rotation axis AA of the rotor 200 shown in FIG. 4). The first surface St11 is connected to the second surface St21 via a curved surface St31 of the middle portion St3. In this embodiment, the curved surface St31 is, for example, a convex surface. In addition, a side of the curved surface St31 connected to the first surface St11 has a relatively steep slope, and the other side of the curved surface St31 connected to the second surface St21 has a relatively gentle slope; however, the present disclosure is not limited thereto. In some embodiments, the curved surface may have the same slope. In some other embodiments, the side of the curved surface connected to the first surface may have a relatively gentle slope, and the other side of the curved surface connected to the second surface may have a relatively steep slope. In still some other embodiments, the curved surface may be a concave surface. In further still some other embodiments, the middle portion may have an inclined surface that is a flat surface instead of the curved surface.

In this embodiment, the quantity of the through holes O of the top part 120 are plural, but the present disclosure is not limited thereto. In some embodiments, the top part 120 may have only one through hole O.

As shown in FIG. 3, a width W1 of the first portion St1 of the ramp St is smaller than a width W2 of the second portion St2 of the ramp St, but the present disclosure is not limited thereto. In some embodiments, the width of the first portion of the ramp may be greater than or equal to the width of the second portion of the ramp.

One end of the outlet channel So is located on the outer surface 122. The outlet channel So is connected to the lower chamber Sd, such that the working fluid in the lower chamber Sd can flow out of the thin pump 10 via the outlet channel So.

As shown in FIG. 4, the upper chamber Su connected to the second surface St21 is located close to the top surface 123 of the top part 120, and the inlet channel Si connected to the first surface St11 is located close to the bottom surface 121 of the top part 120. Therefore, the ramp St may have a sufficient height difference between the first surface St11 and the second surface St21. In such case, a center line C1 of the inlet channel Si is located closer to the bottom surface 121 than a center line C2 of the outlet channel So. However, the present disclosure is not limited thereto. In some embodiments, the center line of the inlet channel may be located further away from the bottom surface than the center line of the outlet channel. In some other embodiments, the center line of the inlet channel may be located at the same level as the center line of the outlet channel.

In addition, in this embodiment, one end of the inlet channel Si and one end of the outlet channel So are respectively located at two opposite sides of the outer surface 122, but the present disclosure is not limited thereto. In some embodiments, one end of the inlet channel and one end of the outlet channel may be respectively located at two adjacent sides of the outer surface.

The cover 130 is disposed on the top surface 123 of the top part 120 via, for example, adhesive. The cover 130 is able to cover the upper chamber Su and the ramp St.

The shaft 400 and the rotor 200 are located in the lower chamber Sd. The shaft 400 is fixed between the bottom part 110 and the top part 120 of the casing 100. The rotor 200 includes an impeller 210, a magnetic component 220, and an iron plate 230. The impeller 210 is fixed on the shaft 400 so that the impeller is rotatably disposed in the casing 100. The magnetic component 220 is disposed on the impeller 210 via the iron plate 230. That is, the iron plate 230 is located between the impeller 210 and the magnetic component 220. The iron plate 230 is configured to reduce magnetic flux leakage so as to increase excitation efficiency.

The washers 500 are sleeved on the shaft 400 and are respectively located at two opposite sides of the impeller 210. The washers 500 are respectively clamped between the impeller 210 and the bottom part 110 and between the impeller 210 and the top part 120, such that the impeller 210, the bottom part 110, and the top part 120 are spaced apart from one another to prevent them from hitting each other during rotation of the impeller 210. In addition, the washers 500 has a wear resistance greater than the casing 100 and therefore can improve the durability and life span of the thin pump 10.

Figure 5:
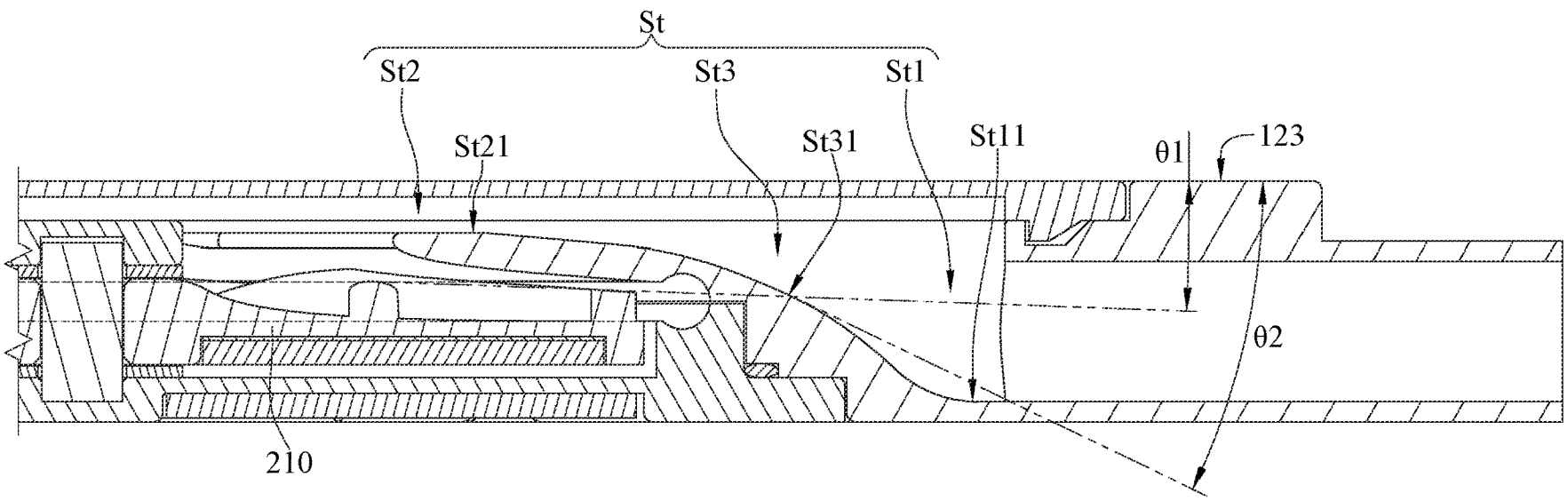
FIG. 5 is a partially enlarged view of the thin pump in FIG. 4.

Please refer to FIG. 5, there is shown a partially enlarged view of the thin pump in FIG. 4. As shown, a plane where a top surface (not numbered) of the impeller 210 is located is angled at an angle θ1 with respect to a plane where the top surface 123 is located, a plane tangential to the curved surface St31 is angled at an angle θ2 with respect to the plane where the top surface 123 is located, and the angle θ2 ranges between (θ1+50% θ1) and (θ1−50% θ1). For example, when the angle θ1 is 10 degrees, the angle θ2 ranges between 5 degrees and 15 degrees. However, the present disclosure is not limited to the range of the angle θ2. In some embodiments, the angle θ2 may be greater than 0 degree and be less than or equal to 90 degrees.

Please refer to FIG. 4, the first portion St1 of the ramp St is connected to the inlet channel Si, and the second portion St2 of the ramp St extends towards a point (not numbered) where the rotation axis AA of the rotor 200 passes. In addition, the second surface St21 of the second portion St2 is located further away from the bottom surface 121 than the rotor 200. When the thin pump 10 is placed in a manner that the bottom surface 121 faces a platform such as a table, the second surface St21 is located at a higher level than the rotor 200. As shown in FIG. 4, the distance D2 between the second surface St21 and the bottom surface 121 is greater than a distance D3 between a top surface (not numbered) of the rotor 200 and the bottom surface 121 in the direction (not shown, parallel to a rotation axis AA of the rotor 200 shown in FIG. 4).

The stator 300 is disposed in the casing 100. The stator 300 corresponds to the magnetic component 220 of the rotor 200 so as to drive the rotor 200 to rotate with respect to the casing 100. Specifically, the bottom part 110 has an accommodating space 112 which is a recess formed on the bottom surface 111. The stator 300 is located in the accommodating space 112. As shown in FIG. 4, the stator 300 is located at a side of the bottom part 110 away from the rotor 200 along the rotation axis AA of the rotor 200. In addition, a depth of the accommodating space 112 is slightly greater than a thickness of the stator 300, such that the stator 300 is prevented from protruding from the bottom surface 111 of the bottom part 110.

As shown in FIG. 4, the stator 300 has a lower surface 310 on a side thereof located close to the bottom surface 121. The impeller 210 has an upper surface 211 on a side thereof located away from the bottom surface 121. The center line C1 of the inlet channel Si is located between a plane where the lower surface 310 of the stator 300 is located and a plane where the upper surface 211 of the impeller 210 is located. The thickness of the inlet channel Si does not affect the total thickness of the thin pump 10.

Note that the position of the inlet channel Si is not restricted. In some embodiments, defining a base line L equidistant from the upper surface 211 and the lower surface 310, a distance between the center line C1 of the inlet channel Si and the base line L may be less than 5 percent of a distance between the upper surface 211 and the lower surface 310. In some other embodiments, the inlet channel may be located between a plane where the upper surface of the impeller is located and a plane where the bottom surface of the top part is located.

As shown in FIG. 3 and FIG. 4, the working fluid flows along a direction indicated by arrow F during the operation of the thin pump 10. In detail, the working fluid flows to the ramp St from the inlet channel Si and then flows over the ramp St to flow into the upper chamber Su, then the working fluid flows down to the impeller 210 accommodated in the lower chamber Sd via the through holes O, and then the working fluid is moved with the impeller 210 and forced to go out of the thin pump 10 from the outlet channel So.

In this embodiment, the inlet channel Si and the outlet channel So are located on the outer surface 122 instead of located on the top surface 123 or the bottom surface 121; that is, the inlet channel Si and the outlet channel So are located at radial sides instead of located at axial sides of the impeller 210. As such, the thickness of the thin pump 10 along the rotation axis AA of the rotor 200 has no need to consider the inlet channel Si and the outlet channel So and thus can be designed to be small. In addition, as mentioned, the working fluid flows along the ramp St, which can reduce the flow resistance of the working fluid to increase the driving efficiency of the thin pump 10. Furthermore, the working fluid flowing down to the impeller 210 from the upper chamber Su can create an impact force due to the height of the ramp St, and the centrifugal force generated by the rotation of the impeller 210 can pressure the working fluid in the lower chamber Sd. As the working fluid flows out of the thin pump 10 from the outlet channel So, the working fluid is pressurized to have a hydraulic head the same as or greater than the conventional axial flow pump (e.g., more than 2 meters).

Note that the description of the location of the inlet channel Si is defined by the bottom surface 121 of the top part 120, but it can be also defined by the bottom surface 111 of the bottom part 110, since the bottom surface 121 of the top part 120 and the bottom surface 111 of the bottom part 110 are substantially coplanar. In some embodiments, the bottom surface of the top part and the bottom surface of the bottom part may not be coplanar. In such case, the one of the two bottom surfaces which is located further away from the top surface of the top part than the other one would be used to define and describe the location of the inlet channel.

Figure 6:
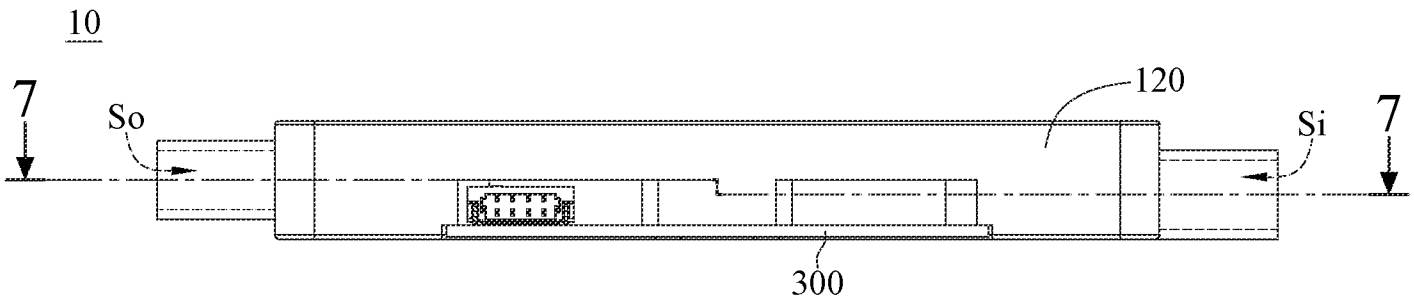
FIG. 6 is a side view of the thin pump in FIG. 1.
Figure 7:
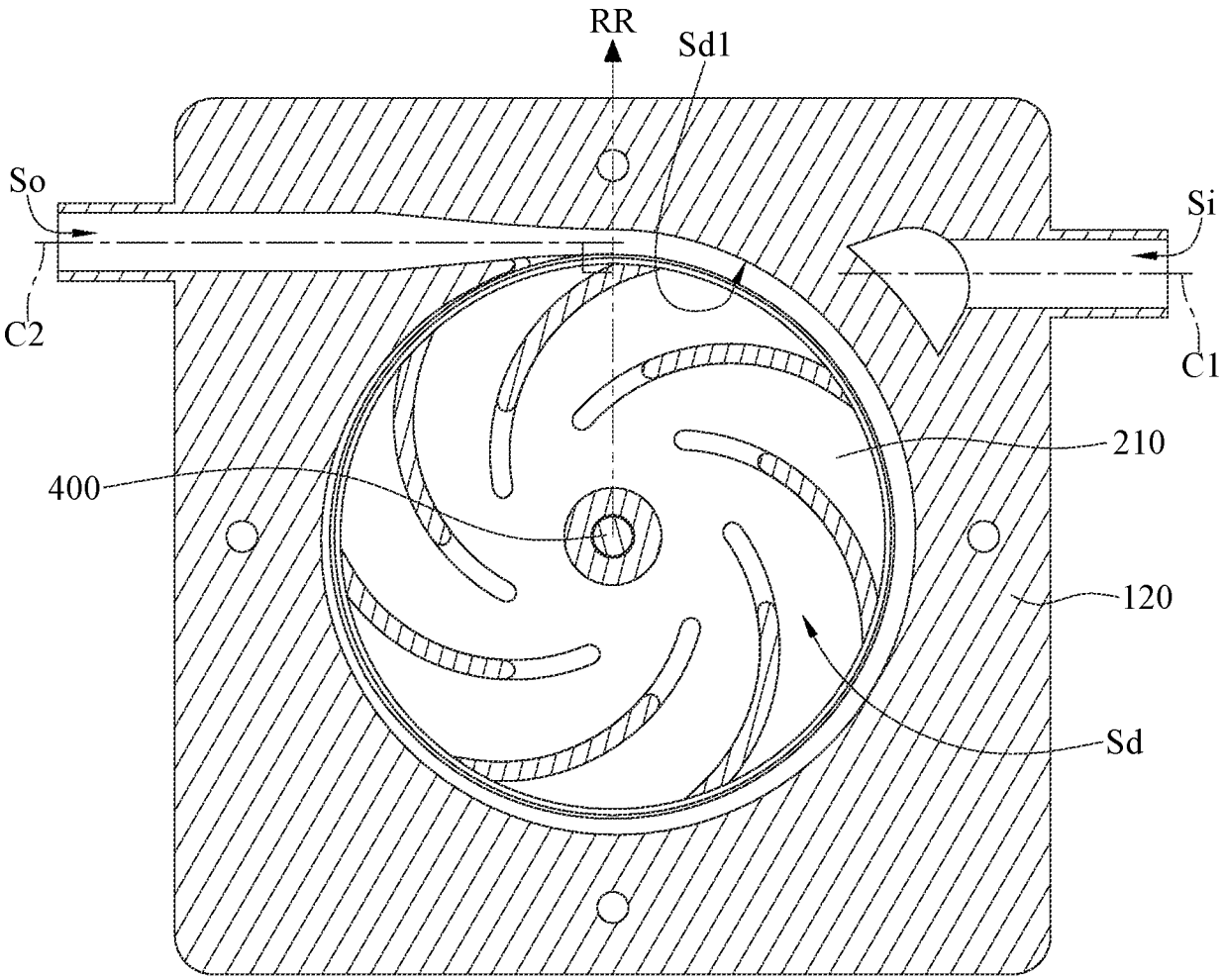
FIG. 7 is a cross-sectional view of the thin pump taken along a line 7-7 in FIG. 6.

Please refer to FIG. 6 and FIG. 7, where FIG. 6 is a side view of the thin pump in FIG. 1, and FIG. 7 is a cross-sectional view of the thin pump taken along a line 7-7 in FIG. 6. As shown in FIG. 7, the center line C2 of the outlet channel So is substantially perpendicular to a radial direction RR of the lower chamber Sd. That is, part of the outlet channel So connected to the lower chamber Sd has an edge substantially tangential to the outer edge (not numbered) of the lower chamber Sd. As such, the direction of the outlet channel So would substantially equal to the tangential velocity of part of the working fluid. This makes the driving efficiency of the thin pump 10 can be increased. However, the present disclosure is not limited thereto. In some embodiments, the center line C2 of the outlet channel may not by perpendicular to the radial direction of the lower chamber.

Figure 8:
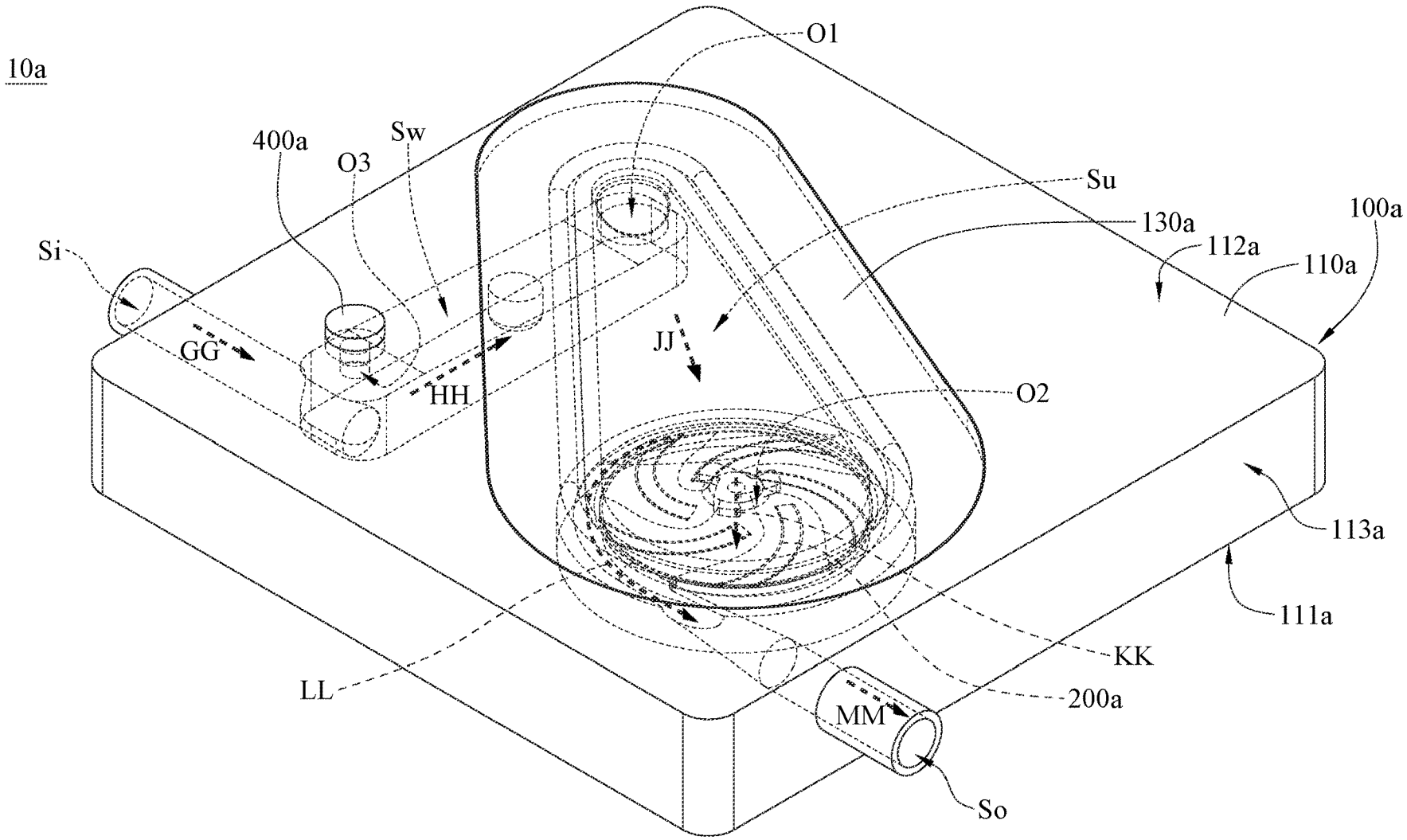
FIG. 8 is a perspective view of a thin pump according to another embodiment of the present disclosure.
Figure 9:
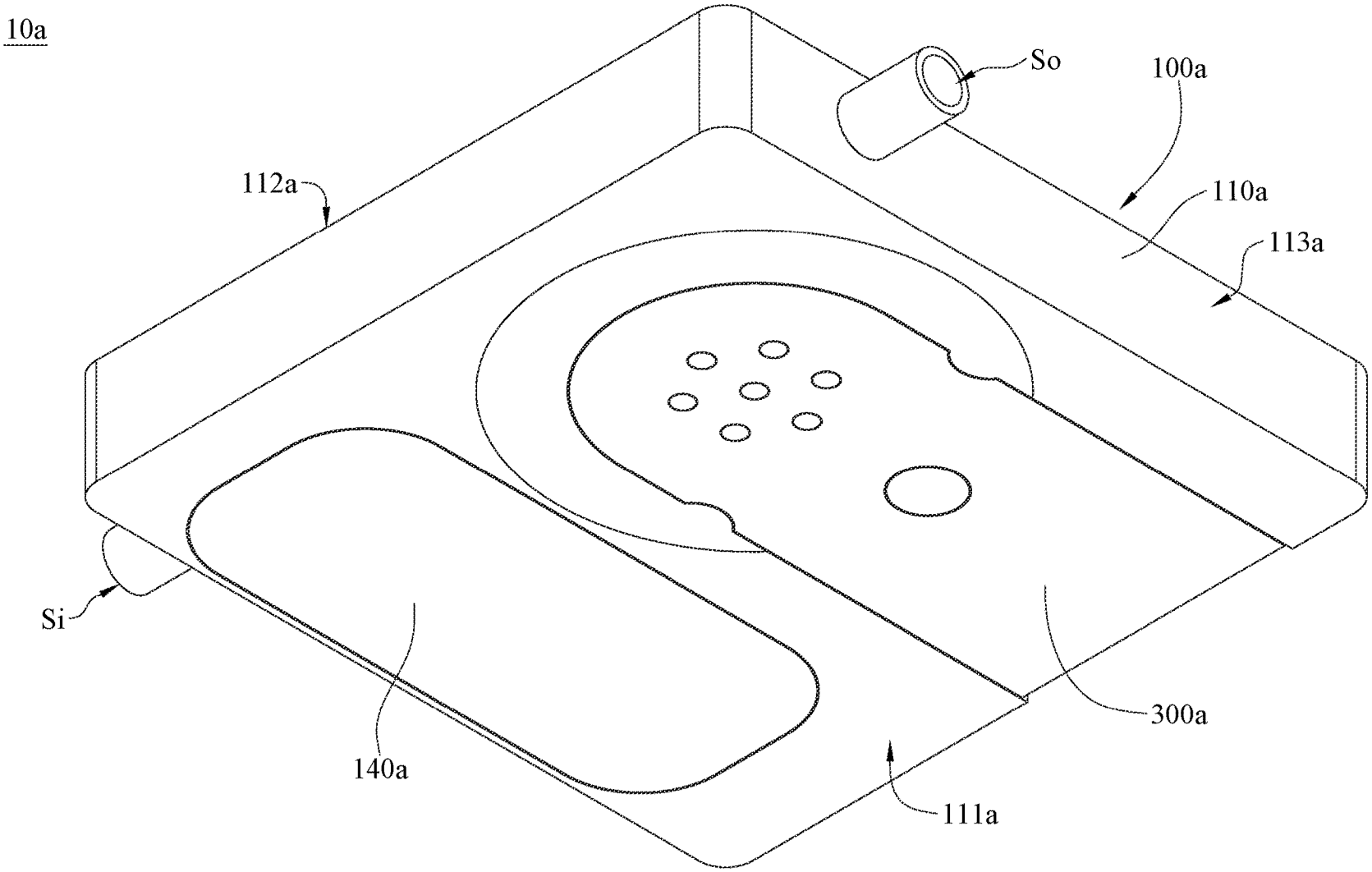
FIG. 9 is another perspective view of the thin pump in FIG. 8.
Figure 10:
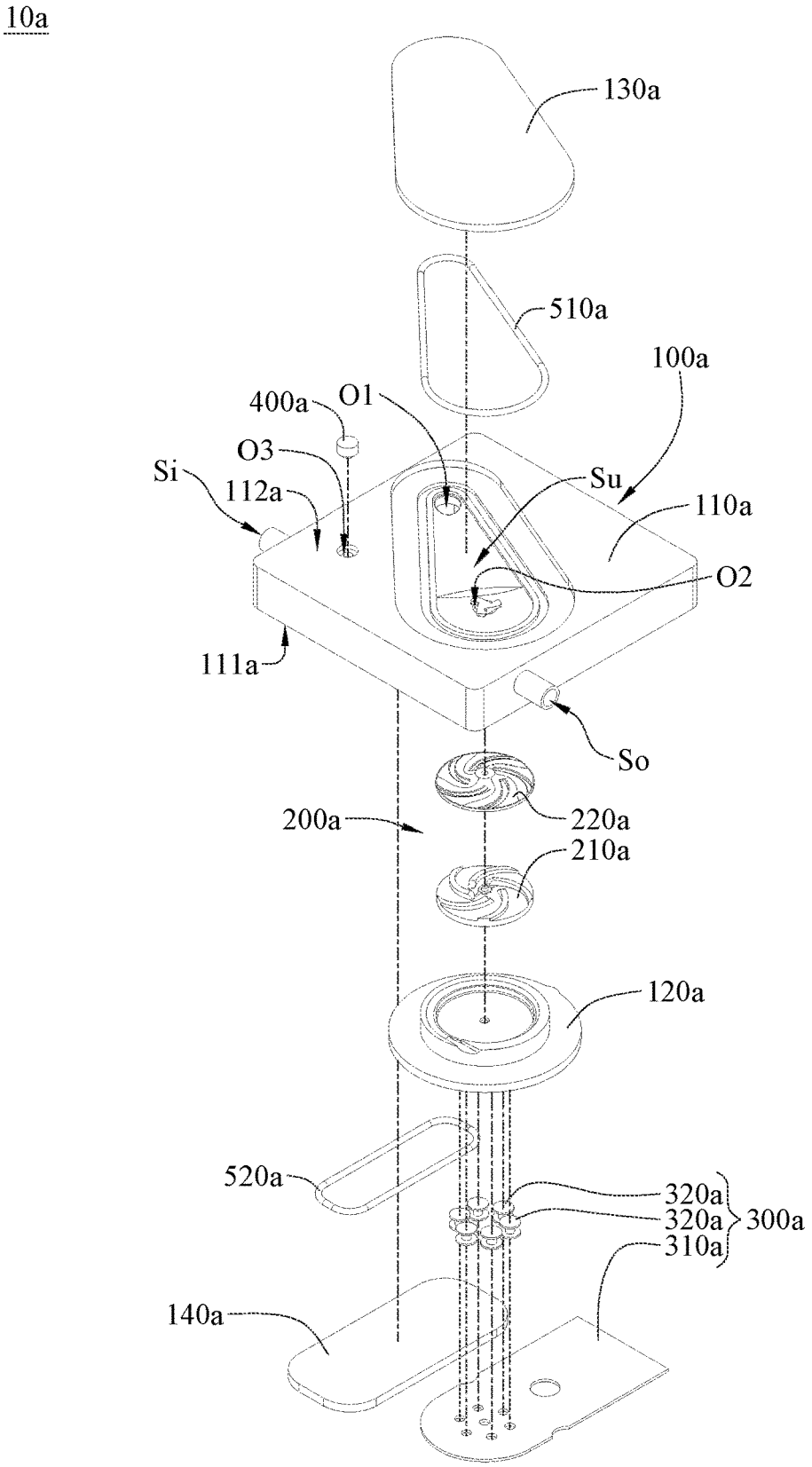
FIG. 10 is an exploded view of the thin pump in FIG. 8.
Figure 11:
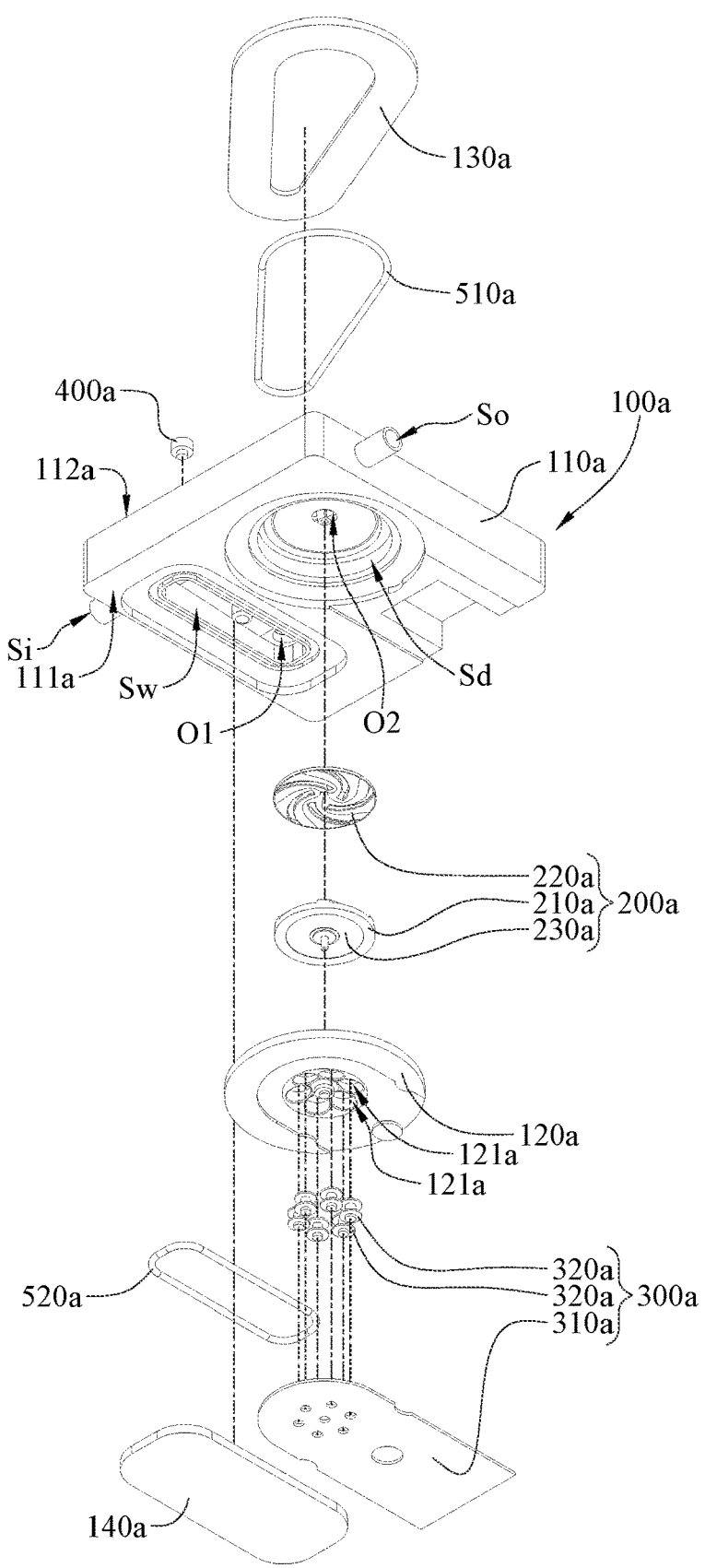
FIG. 11 is an exploded view of the thin pump in FIG. 9.

Please refer to FIG. 8 to FIG. 11, where FIG. 8 is a perspective view of a thin pump according to another embodiment of the present disclosure, FIG. 9 is another perspective view of the thin pump in FIG. 8, FIG. 10 is an exploded view of the thin pump in FIG. 8, and FIG. 11 is an exploded view of the thin pump in FIG. 9.

Another embodiment of the disclosure provides a thin pump 10*a* including a case 100*a*, a rotor 200*a*, and a stator 300*a*. The case 100*a* includes a housing part 110*a*, a base 120*a*, an upper cover 130*a*, and a lower cover 140*a*. The housing part 110*a* has a bottom surface 111*a*, a top surface 112*a*, an outer surface 113*a*, a lower chamber Sd, an upper chamber Su, an accommodation space Sw, an inlet channel Si, and an outlet channel So. Moreover, the housing part

110*a* has a first connection hole O1 and a second connection hole O2. The top surface 112*a* faces away from the bottom surface 111*a*, and the outer surface 113*a* is connected to and located between the bottom surface 111*a* and the top surface 112*a*. The upper chamber Su is located further away from the bottom surface 111*a* than the lower chamber Sd. The upper chamber Su is in fluid communication with the accommodation space Sw via the first connection hole O1, and the upper chamber Su is in fluid communication with the lower chamber Sd via the second connection hole O2. A distance (indicated by D5 in FIG. 12) between the bottom surface 111*a* and a side of the upper chamber Su located close to the second connection hole O2 is greater than a distance (indicated by D4 in FIG. 12) between the bottom surface 111*a* and a side of the upper chamber Su located close to the first connection hole O1. One end of the inlet channel Si and one end of the outlet channel So are located on the outer surface 113*a*, the inlet channel Si is in fluid communication with the accommodation space Sw, and the outlet channel So is in fluid communication with the lower chamber Sd.

The base 120*a* is disposed on the housing part 110*a* and seals the lower chamber Sd. Moreover, the base 120*a* has a plurality of recesses 121*a* that are not in fluid communication with the lower chamber Sd. The upper cover 130*a* is disposed on the housing part 110*a* and seals the upper chamber Su. The lower cover 140*a* is disposed on the housing part 110*a* and seals the accommodation space Sw.

The rotor 200*a* includes an impeller including a first impeller body 210*a* and a second impeller body 220*a*. The rotor 200*a* includes a magnet 230*a*. The first impeller body 210*a* and the second impeller body 220*a* overlap with each other and are rotatably disposed in the lower chamber Sd of the housing part 110*a*. The magnet 230*a* (e.g., a permanent magnet) is disposed on the first impeller body 210*a*. Note that the impeller in some other embodiments of the disclosure may be an integrally formed single piece. It is also noted that the magnet in some other embodiments of the disclosure may be disposed on the second impeller body.

The stator 300*a* includes a driving board 310*a* and a plurality of stator coils 320*a*. The driving board 310*a* abuts on the base 120*a* of the case 100*a*. The stator coils 320*a* are disposed on and electrically connected to the driving board 310*a*. The stator coils 320*a* are respectively located in the recesses 121*a*. The stator coils 320*a* of the stator 300*a* corresponds to the magnet 230*a* of the rotor 200*a*, and the interaction between the stator coils 320*a* and magnet 230*a* can cause the rotor 200*a* to rotate with respect to the case 100*a*.

In this embodiment, the thin pump 10*a* further includes a sealing plug 400*a*. The case 100*a* further has an opening O3 in fluid communication with the accommodation space Sw. The sealing plug 400*a* is configured to be inserted into the opening O3. When the sealing plug 400*a* is removed, the accommodation space Sw is exposed to the outside via the opening O3 so that working fluid (not shown in the drawings) is permitted to flow into the accommodation space Sw via the opening O3. When the sealing plug 400*a* is inserted into the opening O3, the working fluid in the accommodation space Sw is prevented from flowing out of the housing part 110*a*.

Figure 12:
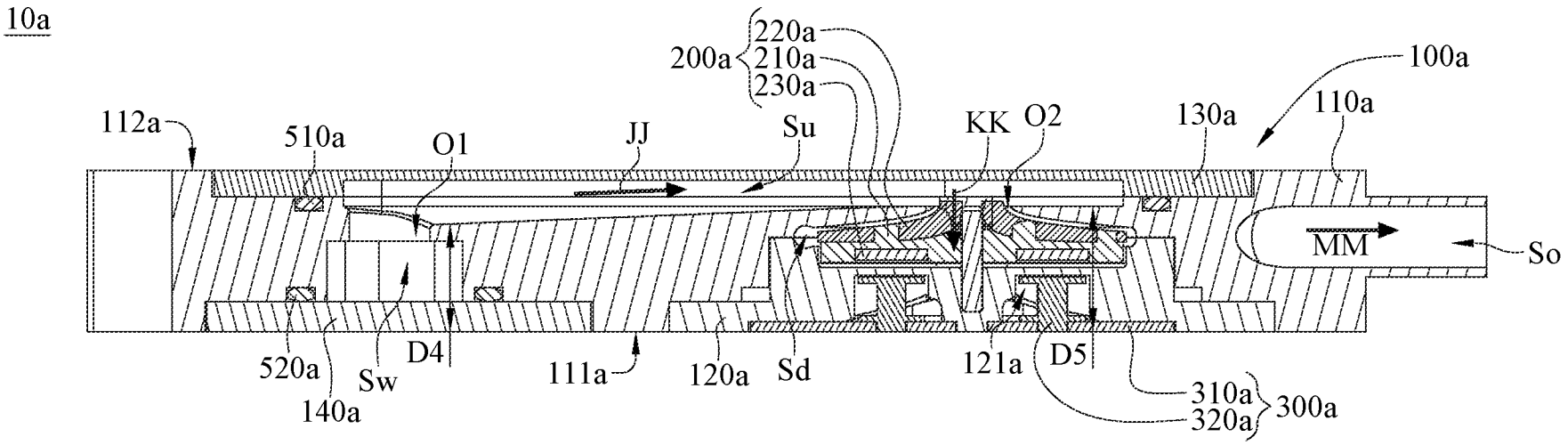
FIG. 12 is a cross-sectional view of the thin pump in FIG. 8.

Please refer to FIG. 10 to FIG. 12, where FIG. 12 is a cross-sectional view of the thin pump in FIG. 8. In this embodiment, the thin pump 10*a* may further includes a first seal ring 510*a* and a second seal ring 520*a* (e.g., rubber seals). The first seal ring 510*a* is clamped between the housing part 110*a* and the upper cover 130*a* to further secure the fluid tight sealing for the upper chamber Su. The second seal ring 520*a* is clamped between the housing part 110*a* and the lower cover 140*a* to further secure the fluid tight sealing for the lower chamber Sd.

Figure 13:
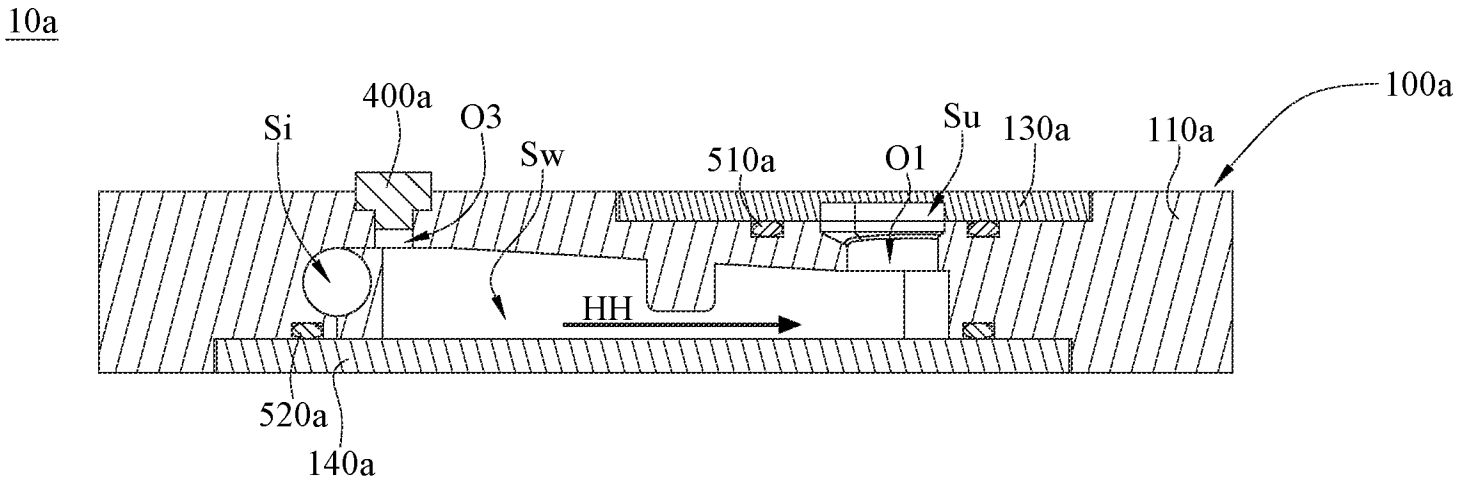
FIG. 13 is another cross-sectional view of the thin pump in FIG. 8.

Please refer to FIG. 8, FIG. 12 and FIG. 13, where FIG. 13 is another cross-sectional view of the thin pump in FIG. 8. The thin pump 10*a* is able to pump a working fluid to flow in, for example, directions as indicated by arrows shown in FIGS. 8 and 12-13. In detail, in FIGS. 8 and 13, working fluid is forced to flow into the inlet channel Si along a direction indicated by an arrow GG and then flow into the accommodation space Sw along a direction indicated by arrows HH. Then, in FIGS. 8 and 12, when the working fluid overflows the accommodation space Sw, the working fluid is then forced to flow into the upper chamber Su through the first connection hole O1 along a direction indicated by an arrow JJ. Then, in FIGS. 8 and 12, the working fluid flows to the lower chamber Sd along the second connection hole O2 as indicated by an arrow KK. Then, as indicated by arrows LL and MM in FIGS. 8 and 12, the working fluid in the lower chamber Sd is discharged out of the thin pump 10*a* from the outlet channel So by being driven by the impeller. As discussed, the accommodation space Sw existing at the upstream side of the upper chamber Su and the lower chamber Sd can be served as a tank for the impeller of the thin pump 10*a*, thus the accommodation space Sw is beneficial to eliminate the bubbles in the working fluid before the working fluid flows into the impeller. As such, there will be no bubbles flowing into the impeller and thus noise that resulted from the bubbles and the impeller is significantly reduced or prevented. In other words, the arrangement of the accommodation space Sw respect to the lower chamber Sd in which the impeller is located makes the thin pump 10*a* have the functions of both a pump and a tank and therefore achieve a balance among small size, high performance, and low noise. Accordingly, the thin pump 10*a* is suitable for a computer system (or an electronic apparatus) with limited internal space while maintaining required cooling performance.

Further, the difference between the distance D5 (the distance between the bottom surface 111*a* and the side of the upper chamber Su located close to the second connection hole O2) and the distance D4 (the distance between the bottom surface 111*a* and the side of the upper chamber Su located close to the first connection hole O1) creates a height difference at the upstream side of the lower chamber Sd, thus the working fluid can flow into the lower chamber Sd from a relatively high altitude and thereby helping increase the hydraulic head of the thin pump 10*a*.

According to the thin pump discussed above, the accommodation space existing at the upstream side of the upper chamber and the lower chamber can be served as a tank for the impeller of the thin pump, thus the accommodation space is beneficial to eliminate the bubbles in the working fluid before the working fluid flows into the impeller. As such, there will be no bubbles flowing into the impeller and thus noise that resulted from the bubbles and the impeller is significantly reduced or prevented. In other words, the arrangement of the accommodation space respect to the lower chamber in which the impeller is located makes the thin pump have the functions of both a pump and a tank and therefore achieve a balance among small size, high performance, and low noise. Accordingly, the thin pump is suitable for a computer system (or an electronic apparatus) with limited internal space while maintaining required cooling performance.

Further, the difference between the distance between the bottom surface and the side of the upper chamber located close to the second connection hole and the distance between the bottom surface and the side of the upper chamber located close to the first connection hole creates a height difference at the upstream side of the lower chamber, thus the working fluid can flow into the lower chamber from a relatively high altitude and thereby helping increase the hydraulic head of the thin pump.

The embodiments are chosen and described in order to best explain the principles of the present disclosure and its practical applications, to thereby enable others skilled in the art best utilize the present disclosure and various embodiments with various modifications as are suited to the particular use being contemplated. It is intended that the scope of the present disclosure is defined by the following claims and their equivalents.

What is claimed is:

1. A thin pump, comprising:

a case comprising a housing part, a base, an upper cover, and a lower cover, wherein the housing part has a bottom surface thereon and has a lower chamber, an upper chamber, and an accommodation space therein, the upper chamber is located further away from the bottom surface than the lower chamber, the upper chamber has two opposite ends respectively in fluid communication with the lower chamber and the accommodation space, the base is disposed on the housing part and seals the lower chamber, the base has a plurality of recesses, the upper cover is disposed on the housing part and seals the lower chamber, and the lower cover is disposed on the housing part and seals the accommodation space;

a rotor comprising an impeller and a magnet, wherein the impeller is rotatably disposed in the lower chamber of the case, and the magnet is disposed on the impeller; and a stator disposed in the case, wherein the stator comprises a driving board and a plurality of stator coils, the driving board abuts on the base, the plurality of stator coils are disposed on and electrically connected to the driving board, and the plurality of stator coils are respectively located in the plurality of recesses of the base, the plurality of stator coils of the stator corresponds to the magnet of the rotor so as to drive the rotor to rotate with respect to the case.

2. The thin pump according to claim 1, wherein the case further has an outer surface, an inlet channel, and an outlet channel, the outer surface is connected to the bottom surface, one end of the inlet channel and one end of the outlet channel are located on the outer surface, the inlet channel is in fluid communication with the accommodation space, and the outlet channel is in fluid communication with the lower chamber.

3. The thin pump according to claim 1, further comprising a sealing plug, wherein the case further has an opening, the opening is in fluid communication with the accommodation space, and the sealing plug is detachably inserted into the opening.

4. The thin pump according to claim 1, wherein the case has a first connection hole and a second connection hole, the upper chamber is in fluid communication with the accommodation space via the first connection hole, the upper chamber is in fluid communication with the lower chamber via the second connection hole, a distance between the bottom surface and a side of the upper chamber located corresponding to the second connection hole is greater than a distance between the bottom surface and a side of the upper chamber located corresponding to the first connection hole.

5. The thin pump according to claim 1, wherein the impeller comprises a first impeller body and a second impeller body overlapping with each other, and the magnet is disposed on one of the first impeller body and the second impeller body.

6. The thin pump according to claim 1, further comprising a first seal ring and a second seal ring, wherein the first seal ring is clamped between the housing part and the upper cover, and the second seal ring is clamped between the housing part and the lower cover.

* * * * *